US006012769A

United States Patent [19]

Hsueh et al.

[11] Patent Number: 6,012,769

[45] Date of Patent: Jan. 11, 2000

[54] CHAIR WITH FOLDABLE BACKREST AND LEGS

[76] Inventors: Tsang-Jung Hsueh, No. 1, Alley 1, Lane 475, Cheng-Chung Rd., San-Min Dist., Kaohsiung; Shaur-Hsiang Chang, Kang-Hou No. 97, Kang-Hou Tsun, A-Lien, Hsiang, Kaohsiung Hsien, both of Taiwan

[21] Appl. No.: 09/248,754

[22] Filed: Feb. 12, 1999

[51] Int. Cl.[7] ..... A47C 4/46

[52] U.S. Cl. ..... 297/19; 297/54; 297/380

[58] Field of Search ..... 297/19, 53, 54, 297/183.5, 380, 381, 382, 482, 17, 129; 248/292.12

[56] References Cited

U.S. PATENT DOCUMENTS

| | | | |
|---|---|---|---|
| 2,676,737 | 4/1954 | Zirbel | 297/482 X |
| 3,138,400 | 6/1964 | Reid | 297/19 |
| 4,838,378 | 6/1989 | Copes | 297/482 X |
| 4,894,877 | 1/1990 | Marsh | 297/53 X |
| 5,289,958 | 3/1994 | Jay | 297/183.5 X |

FOREIGN PATENT DOCUMENTS

| | | | |
|---|---|---|---|
| 791588 | 12/1935 | France | 297/54 |
| 889448 | 1/1944 | France | 297/19 |
| 1187221 | 9/1959 | France | 297/19 |
| 292020 | 7/1953 | Switzerland | 297/380 |
| 644558 | 10/1950 | United Kingdom | 297/54 |

*Primary Examiner*—Peter R. Brown
*Attorney, Agent, or Firm*—Ladas & Parry

[57] ABSTRACT

A chair includes a seat frame, a pair of rear joint unit, a backrest frame, a pair of rear legs, a pair of front joint units, and a pair of front legs. The seat frame has a top side, a bottom side, front and rear ends, and two lateral sides which interconnect the front and rear ends. Each of the rear joint units has a first pivot member disposed above the seat to extend along a direction transverse to the lateral sides of the seat frame, and a second pivot member disposed below the seat frame to extend parallel to the first pivot member. The backrest frame is connected pivotally to the rear joint units via the first pivot members so as to be foldable over the top side of the seat frame. Each of the rear legs is connected pivotally to one of the rear joint units via the second pivot member so as to be foldable over the bottom side of the seat frame. Each of the front joint units has a third pivot member parallel to the second pivot member. Each of the front legs is connected pivotally to one of the front joint units via the third pivot member so as to be foldable over the bottom side of the seat frame.

3 Claims, 8 Drawing Sheets

CHAIR WITH FOLDABLE BACKREST AND LEGS

FIELD OF THE INVENTION

The invention relates to a chair, more particularly to a chair which has a backrest and legs foldable relative to a seat thereof.

BACKGROUND OF THE INVENTION

Chairs of foldable and non-foldable types are known in the art. Most chairs provide only a single function and are therefore not adapted for use in various conditions. Although multi-function chairs are available, they are not convenient to carry along due to their bulky sizes.

SUMMARY OF THE INVENTION

Therefore, the object of this invention is to provide a chair which has a seat member, and a backrest member and legs that are foldable relative to the seat member, and which is convenient to carry.

Accordingly, the chair of this invention includes a seat frame, a pair of rear joint units, a backrest frame, a pair of rear legs, a pair of front joint units, and a pair of front legs. The seat frame has a top side, a bottom side, front and rear ends, and two lateral sides which interconnect the front and rear ends. The rear joint units are mounted immovably on the seat frame at the lateral sides adjacent to the rear end. Each of the rear joint units has a first pivot member disposed above the seat frame to extend along a direction transverse to the lateral sides of the seat frame, and a second pivot member disposed below the seat frame to extend parallel to the first pivot member. The backrest frame is connected pivotally to the rear joint units via the first pivot members so as to be foldable over the top side of the seat frame. Each of the rear legs is connected pivotally to one of the rear joint units via the second pivot member so as to be foldable over the bottom side of the seat frame. The front joint units are mounted immovably on the seat frame at the lateral sides of the seat frame adjacent to the front end. Each of the front joint units has a third pivot member parallel to the second pivot member. Each of the front legs is connected pivotally to one of the front joint units via the third pivot member so as to be foldable over the bottom side of the seat frame.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
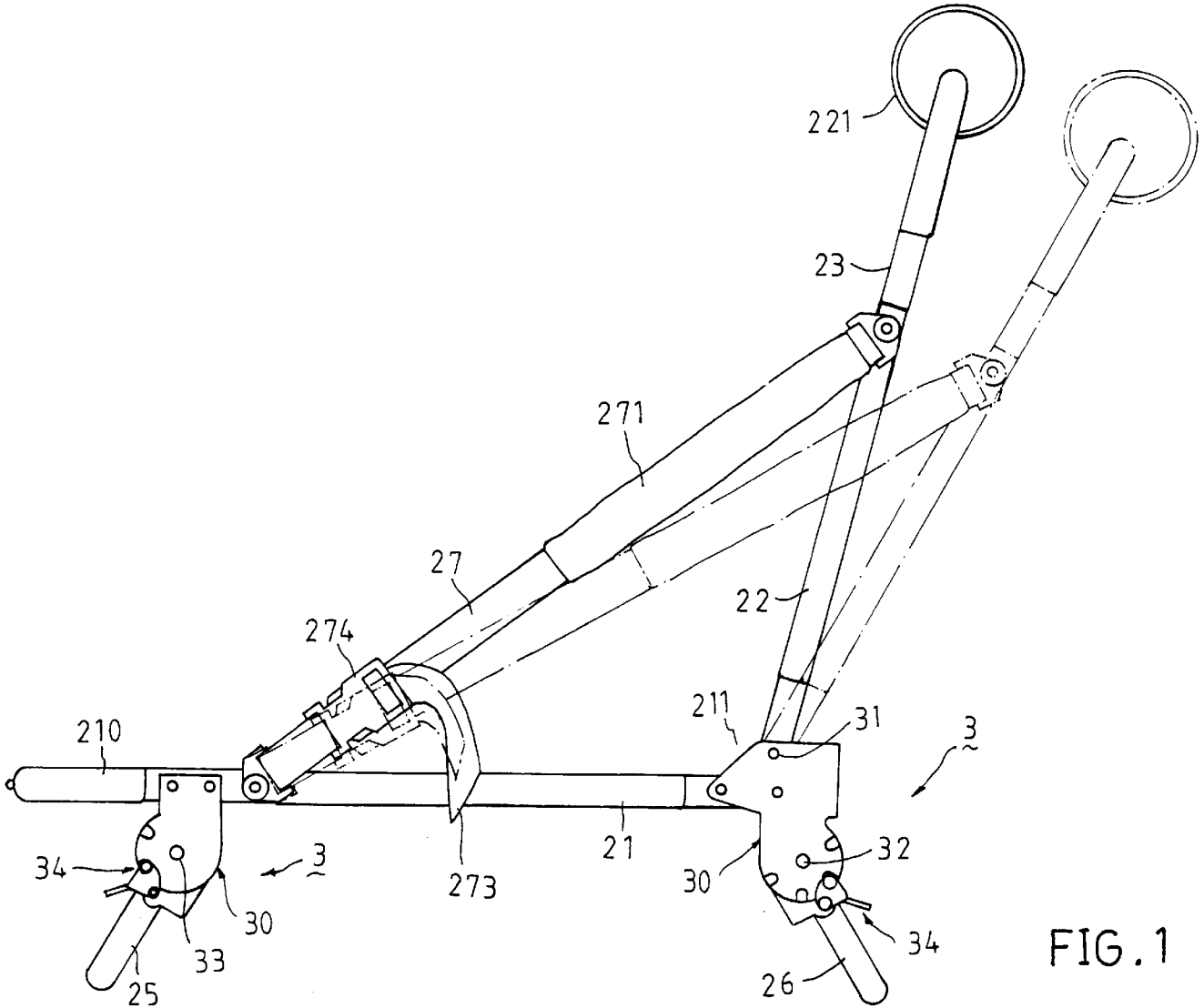
FIG. 1 is a side view of a preferred embodiment of a chair of this invention.
Figure 2:
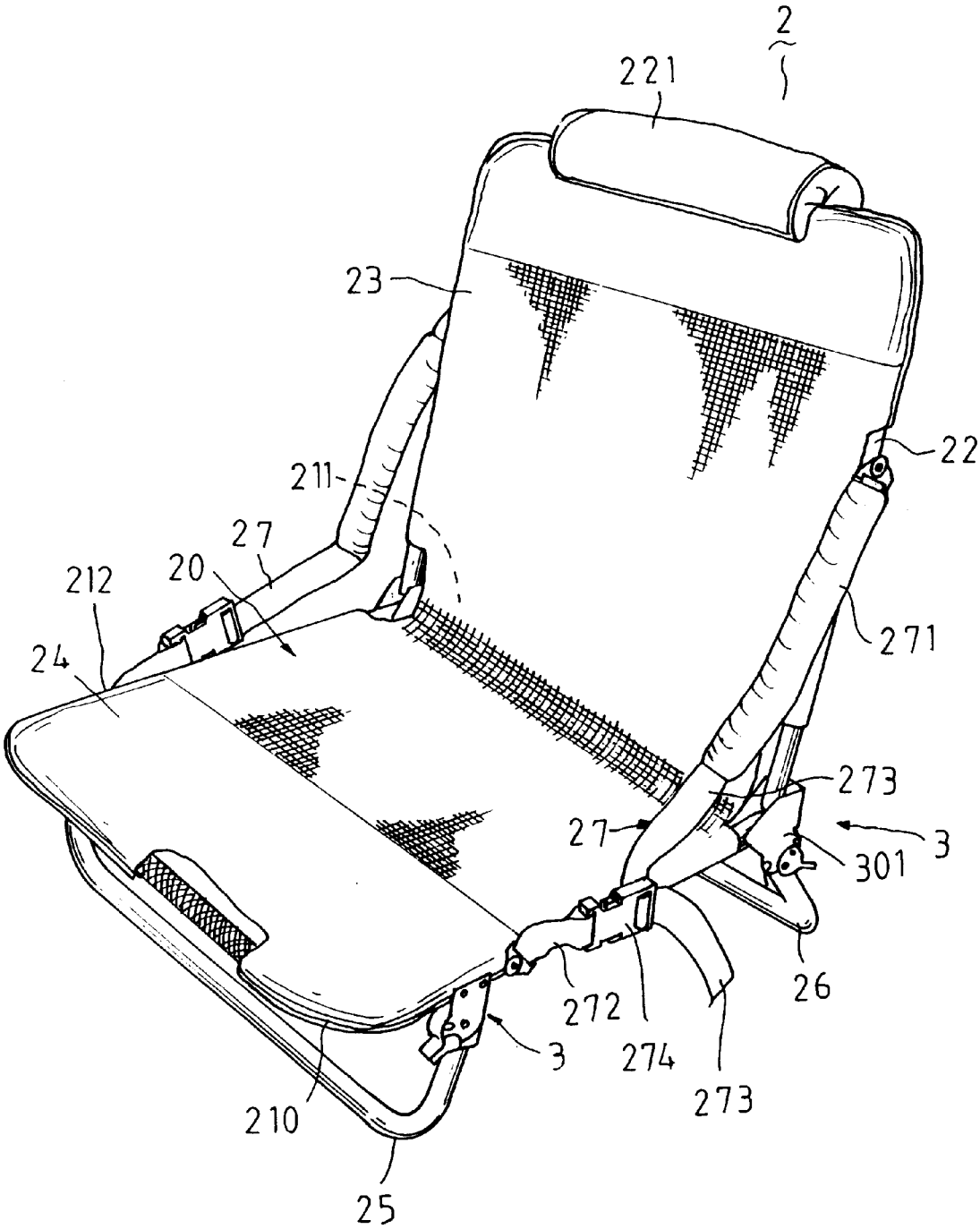
FIG. 2 is a perspective view of the preferred embodiment.
Figure 3:
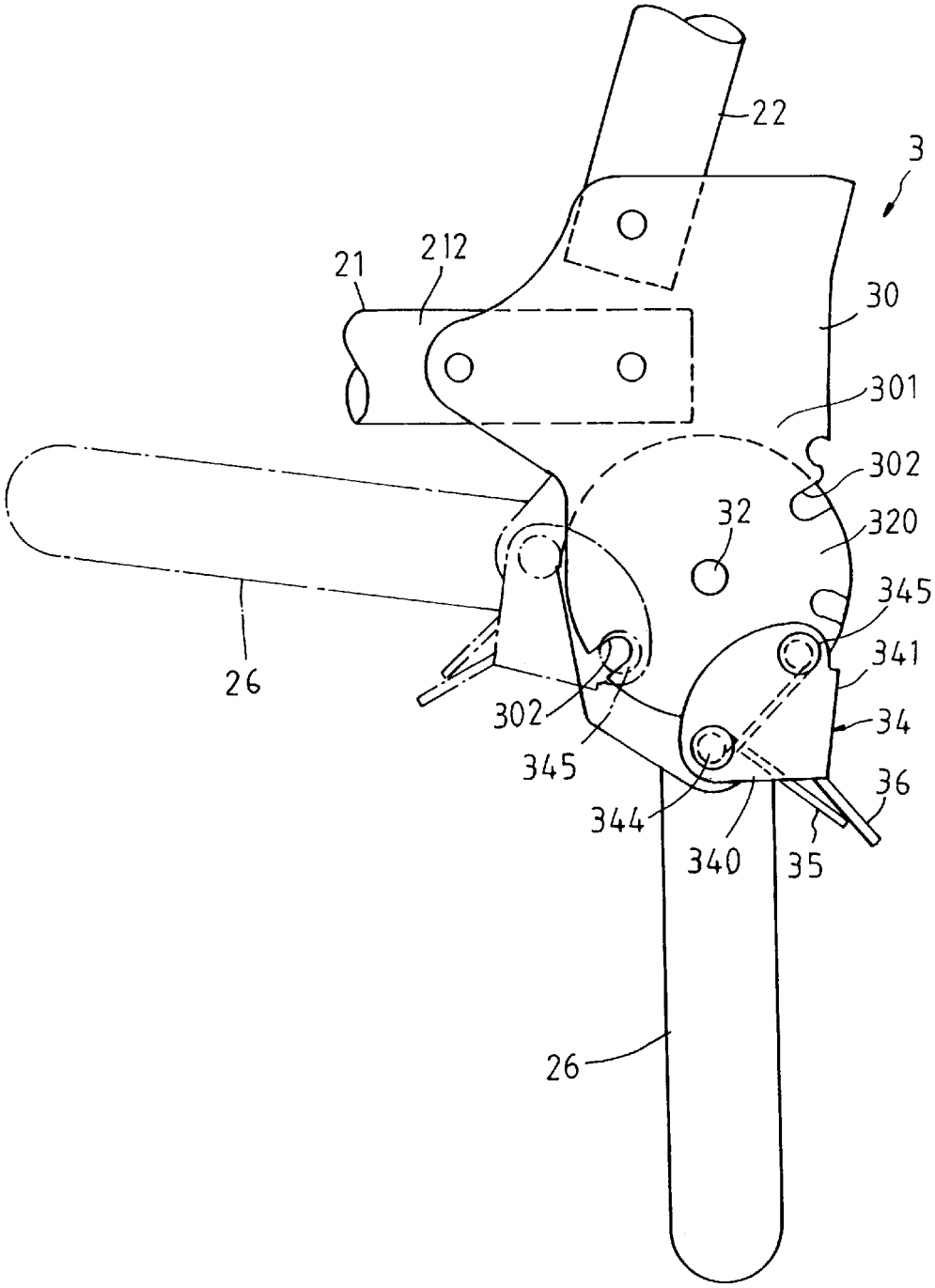
FIG. 3 illustrates how a joint unit interconnects a seat frame, a backrest frame, and a rear leg in the preferred embodiment.
Figure 4:
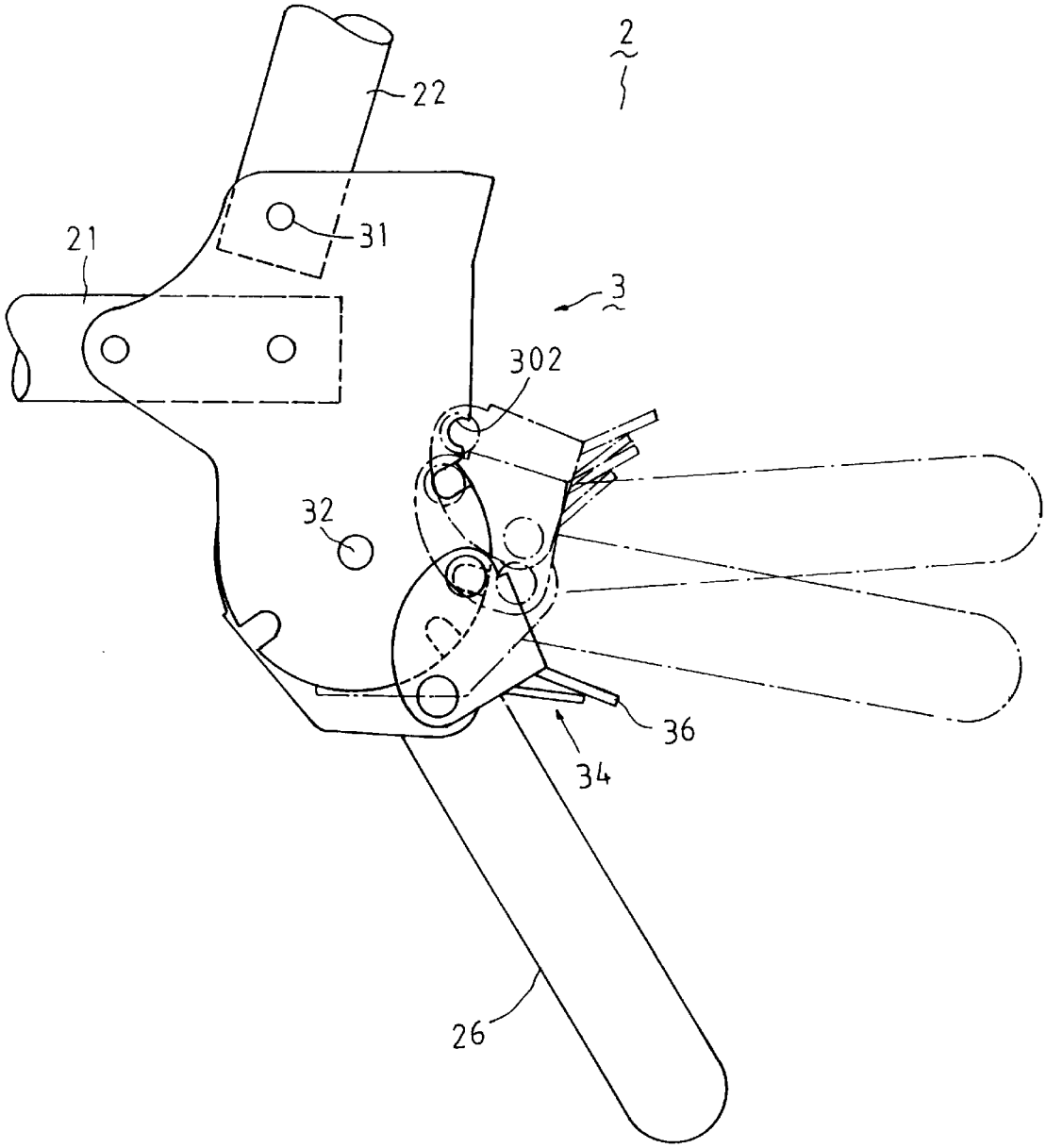
FIG. 4 illustrates angular adjustment of the rear leg with respect to the seat frame of the preferred embodiment.

Referring to FIGS. 1, 2, 3 and 4, the preferred embodiment of a chair 2 according to this invention is shown to include a seat frame 21, a pair of rear joint units 3, a backrest frame 22, a pair of rear legs 26, a pair of front joint units 3, and a pair of front legs 25.

As illustrated, the seat frame 21 has a top side, a bottom side, front and rear ends 210, 211, and two lateral sides 212 that interconnect the front and rear ends 210, 211.

The rear joint units 3 are mounted immovably on the seat frame 21 at the lateral sides 212 adjacent to the rear end 211. Each of the rear joint units 3 has a first pivot member 31 disposed above the seat frame 21 to extend along a direction transverse to the lateral sides 212 of the seat frame 21, and a second pivot member 32 disposed below the seat frame 21 to extend parallel to the first pivot member 31.

The backrest frame 22 is connected pivotally to the rear joint units 3 via the first pivot members 31 so as to be foldable over the top side of the seat frame 21.

Each of the rear legs 26 is connected pivotally to one of the rear joint units 3 via the second pivot member 32 so as to be foldable over the bottom side of the seat frame 21.

The front joint units 3 are mounted immovably on the seat frame 21 at the lateral sides 212 adjacent to the front end 210. Each of the front joint units 3 has a third pivot member 33 disposed below the seat frame 21 parallel to the second pivot member 32.

Each of the front legs 25 is connected pivotally to one of the front joint units 3 via the third pivot member 33 so as to be foldable over the bottom side of the seat frame 21.

The preferred embodiment further includes adjustable locking means 34 associated with each of the front and rear joint units 3 for adjusting and locking each of the front and rear legs 25, 26 relative to the seat frame 21. Each of the front and rear joint units 3 includes a joint member 30 of U-shaped cross-section with two parallel plate portions 301. The plate portion 301 of the joint member 30 of each of the rear joint units 3 project from the seat frame 21 in both upward and downward directions adjacent to the rear end 211 of the seat frame 21. The first pivot member 31 extends through and bridges the plate portions 301 above the seat frame 21. The second pivot member 32 extends through and bridges the plate portions 301 below the seat frame 21. The plate portions 301 of the joint member 30 of each of the front joint units 3 project downwardly from the seat frame 21 adjacent to the front end 210. The third pivot member 33 extends through and bridges the plate portions 301 below the seat frame 21.

The locking means 34 of the rear joint units 3 includes a plurality of engaging elements 302 which are disposed in the plate portions 301 below the seat frame 21 and which are arranged angularly at intervals around the second pivot member 32, and a locking member 340 connected to a corresponding one of the rear legs 26 for engaging selectively the engaging elements 302 so as to lock the corresponding one of the rear legs 26 at a selected inclining angle relative to the seat frame 21.

The locking means 34 of the front joint units 3 includes engaging elements 302 which are disposed in the plate portions 301 below the seat frame 21, and which are arranged angularly at intervals around the third pivot member 33, and a locking member 340 connected to a corresponding one of the front legs 25 for engaging selectively the engaging elements 302 so as to lock the corresponding one of the front legs 25 at a selected inclining angle relative to the seat frame 21.

The plate portions 301 of the front and rear joint units 3 have curved edges that extend angularly relative to the second and third pivot members 32, 33. The engaging elements 302 include a plurality of notches formed along the curved edges. The locking means 34 of the front and rear joint units 3 further includes a U-shaped locking plate 341 which straddles a corresponding one of the front and rear legs 25, 26 and which has a fourth pivot member 344 parallel to the second pivot member 32. The locking plate 341 is connected pivotally to the corresponding one of the front and rear legs 25, 26 via the fourth pivot member 344 below the second pivot member 32. The locking member 340 includes a locking pin 345 mounted on the locking plate 341 to extend parallel to the second pivot member 32 for moving along the curved edges of the plate portions 301 of the joint member 30. Resilient means 35, such as a coil spring, is mounted on the fourth pivot member 344 to bias the locking pin 345 to abut against the curved edges.

The locking plate 341 further has a release tab 36 extending outwardly therefrom and operable to move the locking plate 341 so as to separate the locking pin 345 from the curved edges.

The preferred embodiment further includes a pair of straps 27. Each of the straps 27 has one end connected to the backrest frame 22 and the other end connected to one of the lateral sides 212 of the seat frame 21. Each of the straps 27 includes a short strap component 272 fixed to one of the lateral sides 212 of the seat frame 21, a long strap component 273 fixed to the backrest frame 22, and a buckle 274 for fastening adjustably the long strap component 272 to the short strap component 273. Preferably, each of the straps 27 has a sleeve 271 disposed therearound to serve as an armrest. The top portion of the backrest frame 22 is preferably provided with a cushion 221 to support the head of the user. A fabric sheet 20 is attached to the seat frame 21 and the backrest frame 22, and defines a seat member 24 on the seat frame 21 and a backrest member 23 on the backrest frame 22. The backrest member 23 is foldable over the seat member 24.

Figure 5:
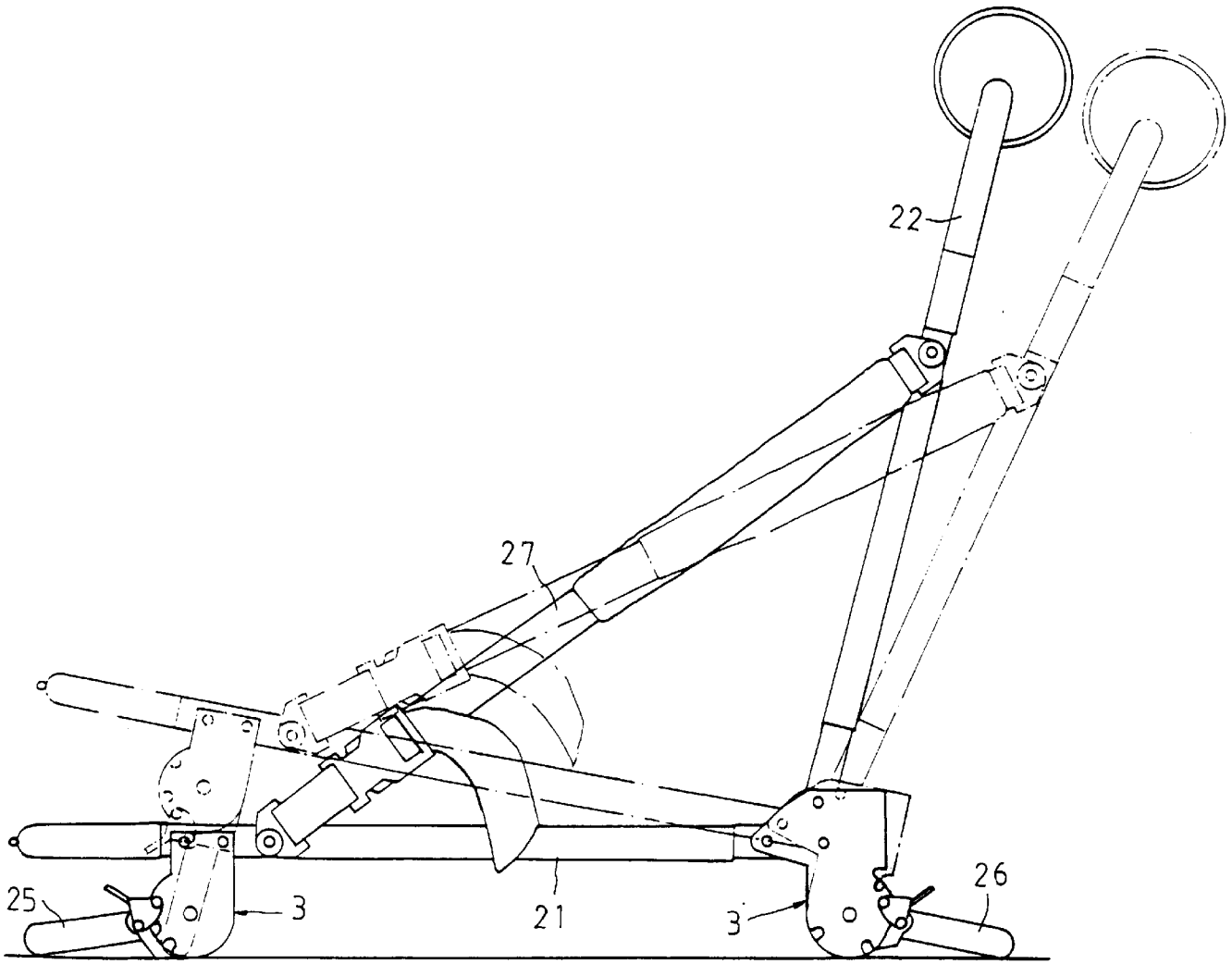
FIG. 5 is a side view of the preferred embodiment, illustrating how the front and rear legs are folded over the bottom side of the seat frame.
Figure 6:
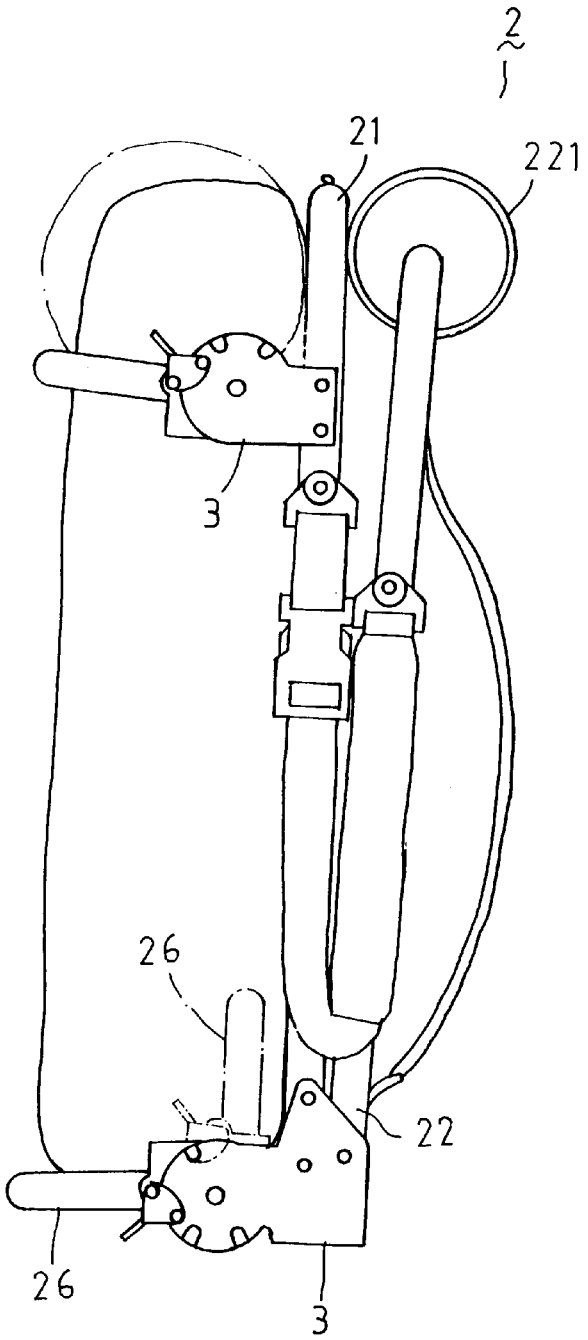
FIG. 6 illustrates how the preferred embodiment is used as a storage device.

Since the front and rear legs 25, 26 can be adjustably locked relative to the seat frame 21 by the use of the locking means 34, the preferred embodiment can be positioned on the ground as desired, as best shown in FIGS. 5 and 6, wherein an object (shown by perforated lines) can be disposed on the front legs 25 for storage.

Figure 7:
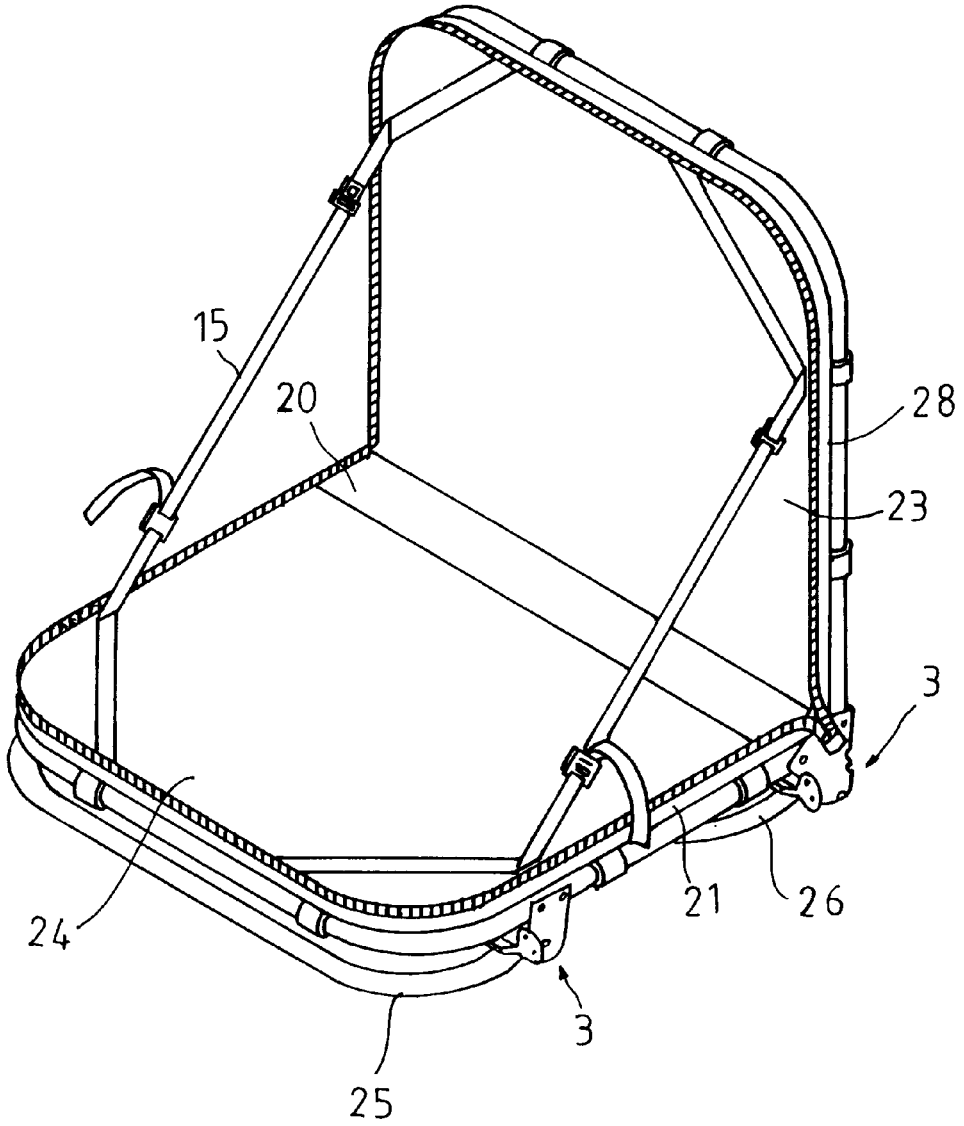
FIG. 7 is a perspective view of the modified preferred embodiment of this invention.
Figure 8:
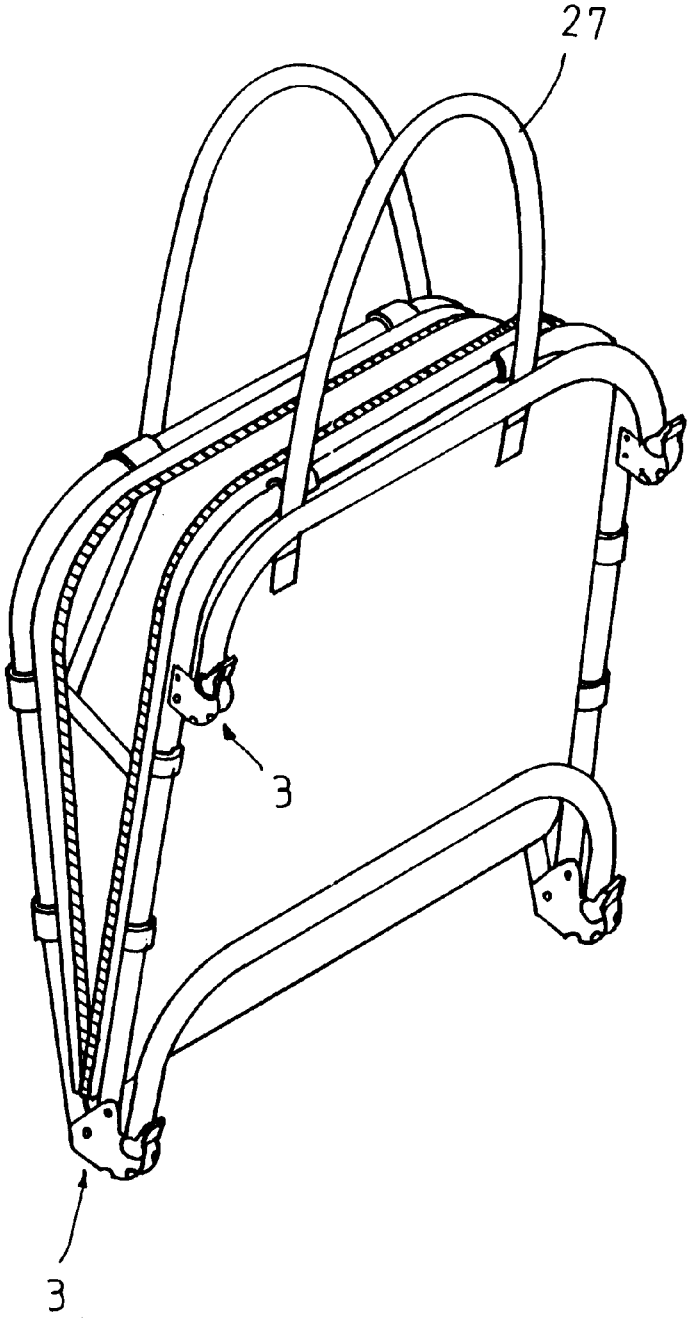
FIG. 8 is another modified preferred embodiment of this invention.

Referring to FIGS. 7 and 8, a modified preferred embodiment is shown to be similar to the previous embodiment in structure except that a fastener 28 is attached to the fabric sheet 20 for fastening together the seat member 24 and the backrest member 23 after the backrest member 23 is folded over the seat member 24. The fastener 28 preferably includes a zipper 29 formed along the periphery of the fabric sheet 20 such that the backrest member 23 and the seat member 24 can be bound together by the zipper 29. The fabric sheet 20 can be further provided with a pair of carrying straps 27 by the use of which the preferred embodiment can be carried along when the latter is folded.

With this invention thus explained, it is apparent that numerous modifications and variations can be made without departing from the scope and spirit of this invention. It is therefore intended that this invention be limited only as indicated in the appended claims.

We claim:

1. A chair, comprising:

a seat frame having a top side, a bottom side, front and rear ends, and two lateral sides interconnecting said front and rear ends;

a pair of rear joint units mounted immovably on said seat frame at said two lateral sides adjacent to said rear end, each of said rear joint units having a first pivot member disposed above said seat frame to extend along a direction transverse to said lateral sides of said seat frame, and a second pivot member disposed below said seat frame to extend parallel to said first pivot member;

a backrest frame connected pivotally to said rear joint units via said first pivot members so as to be foldable over said top side of said seat frame;

a pair of rear legs, each of which is connected pivotally to one of said rear joint units via said second pivot member so as to be foldable over said bottom side of said seat frame;

a pair of front joint units mounted immovably on said seat frame at said two lateral sides adjacent to said front end, each of said front joint units having a third pivot member parallel to said second pivot member;

a pair of front legs, each of which is connected pivotally to one of said front joint units via said third pivot member so as to be foldable over said bottom side of said seat frame; and adjustable locking means associated with each of said front and rear joint units for adjusting and locking each of said front and rear legs relative to said seat frame, each of said front and rear joint units including a joint member of U-shaped cross-section having two parallel plate portions, said plate portions of said joint member of each of said rear joint units projecting from said seat frame in both upward and downward directions adjacent to said rear end of said seat frame, said first pivot member bridging said plate portions above said seat frame, said second pivot member bridging said plate portions below said seat frame; said locking means including a plurality of engaging elements which are disposed in said plate portions below said seat frame and which are arranged angularly at intervals around said second pivot member, and a locking member connected to a corresponding one of said rear legs for engaging selectively said engaging elements so as to lock the corresponding one of said rear legs at a selected inclining angle relative to said seat frame; said plate portions having curved edges extending angularly relative to said second pivot member, said engaging elements including a plurality of notches formed in said curved edges.

2. The chair as defined in claim 1, wherein said locking means further includes a U-shaped locking plate which straddles a corresponding one of said rear legs and which has a fourth pivot member parallel to said second pivot member, said locking plate being connected pivotally to the corresponding one of said rear legs via said fourth pivot member below said second pivot member, said locking member including a locking pin mounted on said locking plate to extend parallel to said second pivot member for moving along said curved edges of said plate portions of said joint member, and resilient means mounted on said fourth pivot member to bias said locking pin to abut against said curved edges.

3.The chair as defined in claim 2, wherein said locking plate has a release tab operable to move said locking plate so as to separate said locking pin from said curved edges.

* * * * *